United States Patent [19]

Starr

[11] Patent Number: 4,522,303

[45] Date of Patent: Jun. 11, 1985

[54] PAYLOAD-PROTECTING SHIPPING CONTAINER

[75] Inventor: James A. Starr, San Jose, Calif.

[73] Assignee: Atasi Corporation, San Jose, Calif.

[21] Appl. No.: 564,814

[22] Filed: Dec. 22, 1983

[51] Int. Cl.[3] ..... B65D 85/38

[52] U.S. Cl. ..... 206/588; 206/305; 206/523; 206/592; 217/53; 220/403

[58] Field of Search ..... 206/305, 317–320, 206/491, 522–524, 586, 588, 591–594, 562; 217/52, 53; 220/400, 403, 408, 410, 902; 229/48 SB, DIG. 8

[56] References Cited

U.S. PATENT DOCUMENTS

| | | | |
|---|---|---|---|
| 644,690 | 3/1900 | Shellenberger et al. | 229/DIG. 8 |
| 1,606,523 | 11/1926 | Gardner | 229/DIG. 8 |
| 1,901,583 | 3/1933 | Conway | 229/DIG. 8 |
| 2,101,282 | 12/1937 | Piper | 229/DIG. 8 |
| 3,033,358 | 5/1962 | Mantell | 206/524 |
| 3,322,323 | 5/1967 | Greene et al. | 229/48 SB |
| 3,520,769 | 7/1970 | Baker | 206/523 |
| 3,565,243 | 2/1971 | Freeman | 206/523 |
| 3,572,574 | 3/1971 | Mears | 206/523 |
| 4,122,946 | 10/1978 | Holley | 206/523 |

FOREIGN PATENT DOCUMENTS

| | | | |
|---|---|---|---|
| 2313659 | 10/1974 | Fed. Rep. of Germany | 206/523 |

*Primary Examiner*—George E. Lowrance
*Assistant Examiner*—Jimmy G. Foster
*Attorney, Agent, or Firm*—Thomas S. MacDonald; Alan H. MacPherson

[57] ABSTRACT

A shipping container for computer peripherals such as disk drives or other payloads is provided in which a bottom cap (21*a*) and apertured block (23*a*), both of resilient foam material, are partially adhesively bonded (as to 27, 28) and inserted separately or as a unit into a closed end of an outer box (10). The payload, contained in an inner box (30,50), is inserted into an aperture (25) in the block (23*a*). A second spaced apertured block (23*b*) and partially bonded top cap (21*b*) are inserted into the top of the box (10) separately or as a unit with the aperture (25) in block (23*b*) holding the top (31) of inner box (30, 50) in suspended position. The box (10) flaps are then closed over the top of block (21*b*). Slits (40) are provided at the corners of the apertures in the blocks to prevent tearing due to repeated shocks to the package.

16 Claims, 4 Drawing Figures

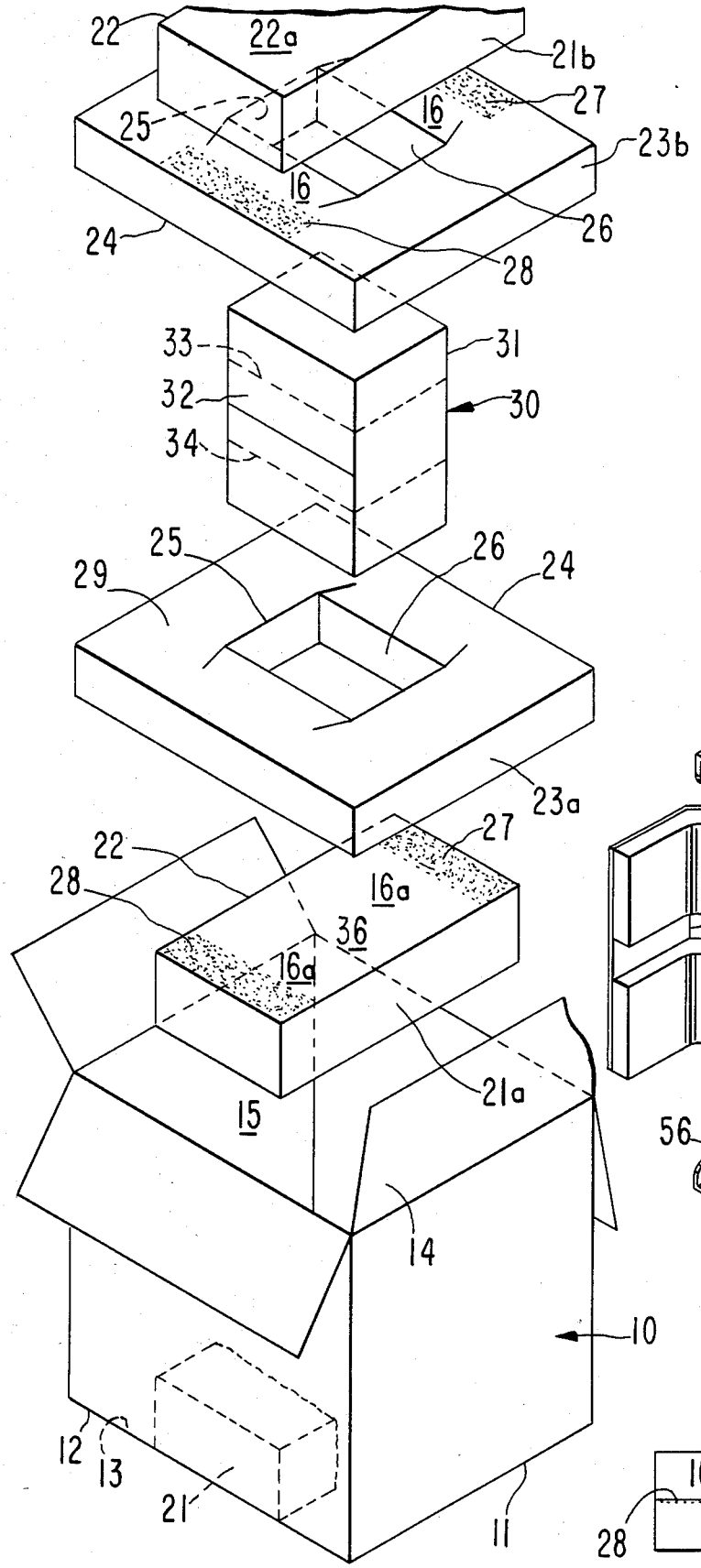
FIG.1
FIG.2
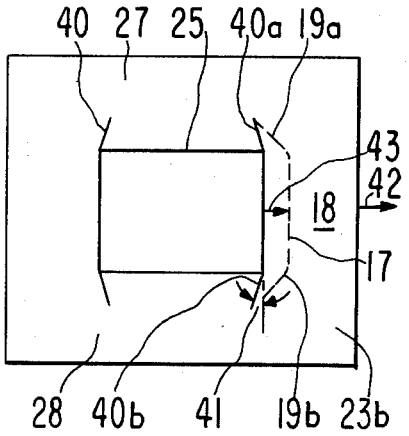
FIG.3
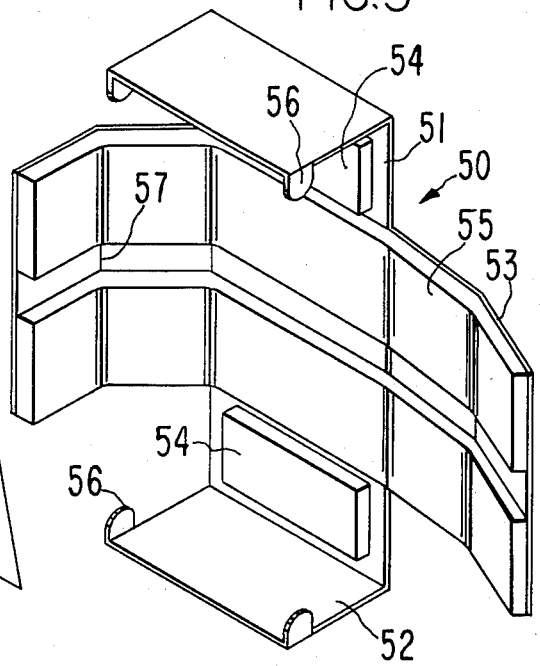
FIG.4
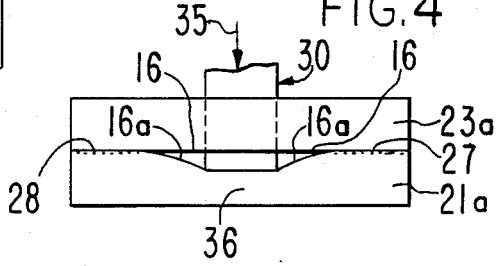

PAYLOAD-PROTECTING SHIPPING CONTAINER

FIELD OF THE INVENTION

This invention relates to support material placed in paperboard or other containers for protection of breakable and valuable payloads from damage during shipment and handling.

DESCRIPTION OF THE PRIOR ART

As is known, various electronic components including computer peripherals are susceptible of damage from physical shock and stress in handling and shipping. Various packing schemes have been proposed and used in an effort to protect such payloads, including various folded paperboard or solid cellular plastic inserts which encapsulate the payload, foam pads glued to the interior sides of the outer box or by pouring in small loose plastic pellets which surround the payload. The packages are designed to meet various drop test specifications including defined drop heights, impact surfaces and box drop angles. In prior art shipping devices the matter of box size and cost has also been a consideration.

SUMMARY

Despite the myriad of package designs in the prior art a need still exists for a package which affords maximum protection for expensive electronic parts and computer peripherals which must be repeatedly handled and shipped by various modes of transportation over long distances, while minimizing cost, complexity and the number of internal parts. Ease of manufacture and ease of packing, unpacking and repacking are also major considerations.

In the case of computer disc drives particularly of the hard disc, low access time, high byte capacity type, suitable protection must be provided to prevent shock and stress to the drive during handling, storage and shipping prior to their incorporation in a computer system. The present invention provides a shipping container which essentially meets the criteria recited above having successfully repeatedly passed drop tests onto concrete surfaces from a height of 42 inches with the assemblage being dropped at various box orientations, the corners, the edges the ends, etc. Other tests such as vibration and test shipments have been made and the described container has met established test criteria.

Essentially the present invention comprises an outer rectangular container having a series of four plastic or other elastomeric or resilient pieces, i.e. two outer caps and two inner apertured blocks positioned within the outer container for suspending a payload, which normally is protected within an interior box. The outer container may be a flapped paperboard or other rectangular box. One outer bottom cap abuts the interior of a closed end of the outer box. A first lower apertured block is positioned abutting the top of the bottom cap and perpendicular thereto, the block filling the cross-sectional area of the outer box and the bottom cap extending across and abutting only one pair of sides of the rectangular outer box. A lower end of the payload is supported and suspended in the first block aperture. A second apertured block similar in configuration to the first block extends in spaced relation above the first block, also fills the cross-sectional area of the outer box and holds the other upper end of the payload in its aperture. The basic container assembly is completed by a top outer cap, duplicative of the bottom cap, abutting the second apertured block and the top of the interior of the outer box in its closed position. It has been found most advantageous to bond, by suitable adhesive, outer edge portions only of said caps to said blocks to prevent tearing during deformation. Angular slits are also provided extending from the corners of the block apertures to prevent tearing in that area and the angle of said slits is selected to add stiffness on the short side for compression due to shock.

BRIEF DESCRIPTION OF THE DRAWING

FIG. 1 is an exploded perspective view of the payload protective shipping container of this invention.

FIG. 2 is a top view of an inner apertured block of this invention showing its slitted edges.

FIG. 3 is a typical protective container for holding the payload in the interior aperture of the apertured blocks.

FIG. 4 is a side view taken from a side opposite the glued outer edges of an apertured block of the invention under deflection conditions.

DETAILED DESCRIPTION

Referring to FIG. 1 a conventional paperboard or other rectangular outer box 10 is provided which has a minor axis 11 and a major axis 12. Suitable flaps 14 are provided on each of the rectangular sides of the box 10 and an interior space 15 provided for packing of a valuable payload such as a computer peripheral device. An interior package 30 which contains the payload is confined protectably within the box 10 by a pair of end caps 21*a* nd 21*b* and a pair of apertured blocks 23*a* and 23*b*. A first end cap 21*a* is positioned so as to have its major axis 22 perpendicular to the major axis 12 of carton 10. The bottom surface of block 21*a* abuts a medial band across the bottom surface 13 of box 10. A first lower apertured block 23*a* is then positioned to be inserted within volume 15 of box 10 after bands 27, 28 of suitable adhesive are laid down at spaced bands 27, 28 on the top surface of bottom cap 21*a*. Adhesive in bands 27 and 28 is kept a distance from the aperture inner edges 26 forming unglued top surface areas 16. Thus, when the block 23*a* is inserted into the carton 10 the cap 21*a* and block 23*a* adhere to each other only at the bonding bands 27 and 28. Alternatively in the preferred assembly technique, the block 23*a* and cap 21*a* are bonded to each other at the bands 27, 28 when outside of the box 10 and inserted as a unit into the box 10.

The partial gluing or adherence of the foam blocks in the recited bands eliminates tearing at the interface upon deflections of the payload which is a common fault in conventional packages.

The partial gluing of the respective blocks to each other provide for repeatable shock isolation for the payload from multiple package drops in the same direction. Conventional arrangements where the entire interface between foamed material is glued results in a first drop causing tearing at an inside edge of the interface because the end foam cap is being compressed and any block to which it is glued cannot follow. Thus, stiffness and performance are reduced in subsequent drops. Partial gluing away from or outboard of the edge of the central aperture allows compression of the end cap without stresses at the apertured block since attachment is not made at the most compressed point. Tearing does not occur and performance is repeatable through multiple drops of the overall package.

The end caps and rectangular blocks are of die cut foamed pad construction and normally made of polyether foam material. In a typical size the end caps are 7 inches wide, 3½ inches deep and 12½ inches long. The apertured blocks are 15 inches long 2½ inches deep and 12½ inches wide.

The package 30 is held in an aperture 25 provided centrally in the apertured block 23*a*. The minor axis 25 of the aperture is at right angles to the major axis 24 of the apertured block. The payload package 30 is inserted into the aperture 25 so that it abuts the top of end cap 21*a* and projects from the top surface 29 of apertured block 23*a* above the dotted line 34 on the package 30. A second apertured block 23*b* is provided which is placed over the upper end 31 of interior payload box 30 so that the under surface of block 23*b* is in the same horizontal plane as the dotted line 33 on the interior package 30. Thus, the vertical distance between dotted lines 33 and 34 on the interior package 30 bridging the blocks 23*a* and 23*b* are not surrounded by foam but rather are contained in an air annulus around the central vertical portions of the box 10 so that the payload is suspended between blocks 23*a* and 23*b*. Lastly, a second top end cap 21*b* is adhesively bonded to bands 27, 28 along the major axis edges of block 23*b* by adhering the cap 21*b* on block 23*b* either before or after its insertion into box 10. The top surface 22*a* of block 21*b* is then in a horizontal plane corresponding to the interior top of box 10. The flaps 14 are then folded down over the surface 22*a* and the flap appropriately sealed on their exterior.

FIG. 2 illustrates a feature of this invention wherein slits normally about 2 inches long are cut at a reentrant angle 41 at each corner of the major axis. The presence of such slits at the aperture corners eliminates tearing and provides a greater stiffness of support on the smaller minor axis aperture side than a slit at an angle bisecting the aperture corner angle. The particular angle of the slits may be selected to give the greatest stiffness. In a typical size rectangular nonsquare box the appropriate angle is in the preferred range of from about 5° to about 15° with a typical finite value of 15°. An angle is selected which is an optimum based on a trade-off between equalizing stiffness on the dissimilar lengths of the sides and resisting tearing adjacent the corners between the sides. Stiffness is dependent on the particular foam used, its density, its thickness and depth. In practice the slits shown in FIG. 2 are analogous to the unglued part of the interface discussed with respect to FIG. 1. The angle of the slit adds to the stiffness of the short side of the aperture reducing the need for additional foam to absorb travel caused by shock on the container. The angle tends to equalize the effective support of the two unequal sides of the rectangular aperture. In the use of square blocks in a square box the slits are at a preferred angle of 45° to the respective sides, i.e., they bisect the right angle edges of the apertures.

Looking at FIG. 2 under no shock loading the load is symmetrically disposed in aperture 25. If the overall package is dropped, the shock upon hitting a floor or other surface as seen by arrow 42 shifts the load in that direction as seen by arrow 43 to dotted position 17 compressing the foam in area 18. At the same time the foam adjacent slits 40*a* and 40*b* is stretched away from the adhesively bonded side edges 27 and 28 as shown by the dotted lines 19*a* and 19*b* helping to support the shifting load. Thus even though the area supported by compression is less than the supporting major axis, the support on the minor axis side is increased to be more equal to that of the longer side of the aperture 25. If the slits bisect the corner angle, i.e., they are at 45°, no stretching occurs upon dropping and support would be as unequal as the respective lengths of the aperture sides.

As a result of the design described in FIGS. 1 and 2 the interior package containing a valuable payload such as a disk drive is protected during handling within the manufacturing or user facility and can be easily loaded in its shipping carton. If by any cause the package is dropped, no tearing of the foamed protective blocks is permitted during usual deformations of the foam (when it is shock compressed by the shifting load) due to the partial gluing of the respective caps and blocks and the angle cuts or slits formed adjacent the aperture in the blocks.

In a typical application the aperture within the aperture blocks has a 4½ inch by 7⅛ inch dimension with a height of 2½ inches. Typically, the payload box 30 has a dimension of 4½ inches by 7⅛ inches×9½ inches. It is to be understood that the adhesive bonds may extend further to the outer edges of the end cap but leaving an unglued area at the central aperture. Also, the end caps may cover the entire top and/or bottom of the box 10 in which event the glued bands extend peripherally around the aperture 25 but spaced outwardly therefrom leaving an unglued band next to and around the aperture. Blocks 23*a* and 23*b* may abut thus not having an air gap therebetween. The thickness of blocks 23*a* and 23*b* must be such so as to retain and keep the box 30 or payload captured during box deflections or movement due to shock loads.

FIG. 3 illustrates an interior protective box which may be utilized with the invention described in FIG. 1. Interior box 50 comprises a series of flaps 51, 52 and 53 which are foldable about the particular payload. Flaps 53 are foldable in one axis of the box and contain a series of foam blocks 55 adhered to the inner surface of the flap 53. Flaps 51 and 52 have rectangle foam blocks 54 on one foldable section thereof. After flaps 53 are wrapped around the payload the flaps 51 and 52 are then folded over the edges of flaps 53 and tabs 56 on flaps 51 and 52 inserted into tab slots 57 on flaps 53 to form the complete inner package. Package 50 is then positioned and suspended in the manner shown in FIG. 1 and held by the apertured blocks 23*a* and 23*b* as illustrated. In some usages, the payload itself without an inner protective box may be positioned in the apertured blocks.

FIG. 4 illustrates the separation of the unglued edges 16, 16*a* of the block 23*a* and end cap 21*a*, respectively, caused by the deflection or movement of box or payload 30 indicated by arrow 35. The edges 16*a* thus follow the box 30 as it deflects downwardly compressing the foam in area 36 without any tearing of the outer interface bond in bands 27 and 28. In a typical application, the lateral distance across unglued band 16*a* would preferably be at least one inch with the width or lateral distance of the glue-containing band sufficient to form an adequate bond.

The above description of embodiments of this invention is intended to be illustrative and not limiting. Other embodiments of this invention will be obvious to those skilled in the art in view of the above disclosure.

I claim:

1. In a shipping container for protection of a payload from shock loading comprising:

an outer rectangular box having at least one open but closable end;

a rectangular resilient bottom cap abutting a closed end of said outer box;

a first rectangular resilient block abuttingly mounted on said cap and having a central aperture to support one end of an inserted payload, said first block having a height sufficient to support said one end of an inserted payload, and said first block having length and width dimensions corresponding to the internal length and width of said outer box;

a second rectangular resilient block having a central aperture to support a second end of said inserted payload, said second block having a height sufficient to support said second end of said inserted payload, said second block having length and width dimensions corresponding to the internal length and width of said outer box; and a rectangular resilient top cap abutting a top surface of said second block and having a top surface in a plane corresponding to the closable end of the outer box in closed position, the improvement comprising:

means for adhering only selected edge portions outwardly spaced from said central apertures in each of said blocks to corresponding portions of the bottom and top caps abutting each of said blocks leaving unadhered portions for stress relieving said blocks upon imposition of a force.

2. The invention as set forth in claim 1 further including means for forming slits in said blocks extending into said blocks from said apertures.

3. The invention as set forth in claim 2 in which the payload-supporting apertures are rectangular with unequal length sides and said slits extend at an angle from each of the corners of said apertures.

4. The invention as set forth in claim 2 in which the payload-support apertures are square and said slits bisect an angle with each of the corners of said apertures.

5. The invention as set forth in claim 3 in which said slits which extend from the corners of said aperture at an angle extending in a direction away from the wall supporting the parallel short sided edges of said apertures to increase stiffness of said short sides.

6. The invention as set forth in claim 5 in which said angle is from about 5° to about 15° and said slits equalize the area of said outer rectangular box supporting the unequal sides of the aperture.

7. The invention as set forth in claim 1 in which said caps are of duplicate configuration and said blocks are of duplicative configuration and wherein a partially adhesively bonded cap-block combination is inserted as a unit into said outer box.

8. The invention as set forth in claim 1 in which payload-supporting apertures are rectangular with unequal length sides and said adhesively bonded edge portions extend from a position outboard of said apertures to a position inboard of the outer edges of said caps and blocks and extend along the larger of the unequal sides of said apertures.

9. The invention as set forth in claim 1 in which said means for adhering comprises bands of adhesive extending from a position outboard of said apertures to a position inboard of the outer edges of said caps and blocks.

10. In a shipping container for protection of a payload from shock loading comprising:

an outer rectangular box having at least one open but closable end;

a rectangular resilient bottom cap abutting a closed end of said outer box;

a first rectangular resilient block abuttingly mounted on said cap and having a central aperture to support one end of an inserted payload, said first block having a height sufficient to support said one end of an inserted payload, and said first block having length and width dimensions corresponding to the internal length and width of said outer box;

a second rectangular resilient block having a central aperture to support a second end of said inserted payload, said second block having a height sufficient to support said second end of said inserted payload, said second block having length and width dimensions corresponding to the internal length and width of said outer box; and a rectangular resilient top cap abutting a top surface of said second block and having a top surface in a plane corresponding to the closable end of the outer box in closed position, the improvement comprising:

means for forming slits in said first and second blocks extending into said blocks at an angle from each of the corners of said apertures for stress relieving said blocks upon the imposition of a force, where said stress relieving occurs near the corners of said apertures as the sides of said slits are forced to separate.

11. The invention as set forth in claim 10 in which said apertures are rectangular.

12. The invention as set forth in claim 11 in which the adjacent sides of said rectangular apertures are unequal in length and said slits more equalize loading support of the shorter sides to that of the larger sides when said box is subjected to shock loading on said shorter sides.

13. The invention as set forth in claim 12 in which the angle of said slits extending from the corners of said aperture away from the wall supporting said short sides of the aperture is about 5° to about 15°.

14. The invention as set forth in claim 10 in which said apertures are square and the angle of said slits is 45°.

15. The invention as set forth in claim 10 in which said angle is selected to equalize compressive stiffness of the resilient blocks supporting dissimilar lengths of different sides of said apertures and to resist tearing of the resilient blocks near the corners of said apertures.

16. A resilient cap abutting an end of an outer box;

a resilient block abuttingly mounted on said cap and having a central aperture to support one end of an inserted payload, said block having a height sufficient to support said one end of an inserted payload;

including means for adhering only selected edge portions outwardly spaced from said central aperture in said block to corresponding portions of the cap abutting said block leaving unadhered portions for stress relieving said block and cap upon imposition of a force, and further including means for forming slits in said block extending into said block from the corners of said aperture in a direction away from the edges of said aperture for stress relieving said block upon imposition of a force.

* * * * *